US012532920B2

(12) United States Patent
Su et al.

(10) Patent No.: US 12,532,920 B2
(45) Date of Patent: Jan. 27, 2026

(54) ELECTRONIC VAPORIZATION DEVICE

(71) Applicant: Jiangmen Moore Technology., Ltd, Guangdong (CN)

(72) Inventors: Yanqin Su, Jiangmen (CN); Feng Xiao, Jiangmen (CN)

(73) Assignee: Jiangmen Moore Technology., Ltd, Jiangmen (CN)

( * ) Notice: Subject to any disclaimer, the term of this patent is extended or adjusted under 35 U.S.C. 154(b) by 473 days.

(21) Appl. No.: 18/088,028

(22) Filed: Dec. 23, 2022

(65) Prior Publication Data

US 2023/0210190 A1 Jul. 6, 2023

(30) Foreign Application Priority Data

Dec. 31, 2021 (CN) ..... 202123455155.9

(51) Int. Cl.
*A24F 40/57* (2020.01)
*A24F 40/51* (2020.01)

(52) U.S. Cl.
CPC ..... *A24F 40/57* (2020.01); *A24F 40/51* (2020.01)

(58) Field of Classification Search
None
See application file for complete search history.

(56) References Cited

U.S. PATENT DOCUMENTS 10,357,063 B1 * 7/2019 Fornarelli ..... A61M 15/06
2017/0325507 A1 * 11/2017 Xiang ..... F22B 1/284
2017/0347714 A1 * 12/2017 Metz ..... A24F 40/485
2020/0359704 A1 * 11/2020 Deng ..... A24F 40/70
2021/0106051 A1 * 4/2021 Han ..... A24F 40/30
2021/0345668 A1 * 11/2021 Casselman ..... A24F 40/46
2022/0211116 A1 * 7/2022 Desnerck ..... A24F 40/60
2022/0322747 A1 * 10/2022 Zominy ..... A24F 40/53

FOREIGN PATENT DOCUMENTS

EP 3838012 A1 * 6/2021 ..... A24F 40/44

OTHER PUBLICATIONS

Chinese Patent Office, First Office Action in Chinese Patent Application No. 202123455155.9 (Jun. 1, 2022).
Chinese Patent Office, Second Office Action in Chinese Patent Application No. 202123455155.9 (Sep. 1, 2022).
Chinese Patent Office, Notice of Registration and Notification to Grant Patent Right in Chinese Patent Application No. 202123455155.9 (Oct. 8, 2022).

* cited by examiner

*Primary Examiner* — Philip Y Louie
*Assistant Examiner* — Morgan Faith Dezendorf
(74) *Attorney, Agent, or Firm* — Leydig, Voit & Mayer, Ltd.

(57) ABSTRACT

An electronic vaporization device includes: a vaporization assembly; a first power supply unit; a second power supply unit; and a control unit. The vaporization assembly vaporizes an aerosol generating substrate. The first power supply unit and the second power supply unit supply power to the vaporization assembly. The control unit controls the first power supply unit and the second power supply unit to supply power to the vaporization assembly according to a temperature of the vaporization assembly.

17 Claims, 4 Drawing Sheets

ELECTRONIC VAPORIZATION DEVICE

CROSS-REFERENCE TO PRIOR APPLICATION

Priority is claimed to Chinese Patent Application No. 202123455155.9, filed on Dec. 31, 2021, the entire disclosure of which is hereby incorporated by reference herein.

FIELD

The present disclosure relates to an electronic vaporization device, and more specifically, to an aerosol generating device.

BACKGROUND

Compared with conventional burning cigarettes, the electronic vaporization device can effectively reduce harmful substances such as tar and carbon monoxide. As a substitute for the conventional burning cigarettes, the electronic vaporization device has a trend of increasing demand year by year. The electronic vaporization device is configured to vaporize an aerosol generating substrate (such as e-liquid, or roots, stems, and leaves of a plant, and other mixtures) to generate aerosol for a user to inhale. The electronic vaporization device generally includes a vaporization assembly and a power supply unit. The power supply unit is configured to supply power to the vaporization assembly. The vaporization assembly is configured to heat the aerosol generating substrate to produce the aerosol for the user to inhale.

In the existing electronic vaporization device, a certain temperature is required to vaporize the aerosol generating substrate, so that the aerosol generating substrate has a good inhaling taste after being heated and vaporized. In order to make the electronic vaporization device vaporize the aerosol with a better taste in a short time after starting, the power supply unit is required to provide appropriate power for the vaporization assembly, so that the vaporization assembly can heat up quickly and reach the desired vaporization temperature. The power supply capability of the battery of the current electronic vaporization device has difficulty in allowing the vaporization assembly to rapidly heat up to the desired vaporization temperature in a short time. As a result, at an initial stage of the startup of the electronic vaporization device, the vaporized aerosol tastes bad and the user experience is not good.

SUMMARY

In an embodiment, the present invention provides an electronic vaporization device, comprising: a vaporization assembly; a first power supply unit; a second power supply unit; and a control unit, wherein the vaporization assembly is configured to vaporize an aerosol generating substrate, wherein the first power supply unit and the second power supply unit are configured to supply power to the vaporization assembly, and wherein the control unit is configured to control the first power supply unit and the second power supply unit to supply power to the vaporization assembly according to a temperature of the vaporization assembly.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
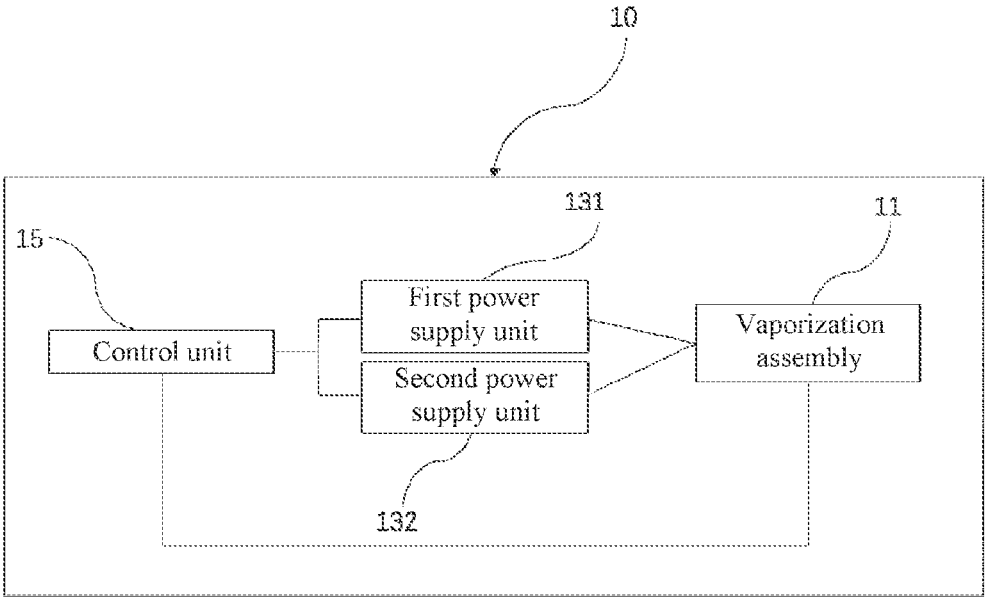
FIG. 1 is a structural block diagram of an electronic vaporization device in an embodiment of the present disclosure.

In an embodiment, the present invention provides an electronic vaporization device to overcome the deficiency of the existing electronic vaporization device. The electronic vaporization device can heat up rapidly at an initial stage of startup, and vaporize an aerosol generating substrate at a desired vaporization temperature, which provides a better user experience.

In an embodiment, the present invention provides an electronic vaporization device, where the electronic vaporization device includes a vaporization assembly, a first power supply unit, a second power supply unit, and a control unit, where the vaporization assembly is configured to vaporize an aerosol generating substrate; the first power supply unit and the second power supply unit are configured to supply power to the vaporization assembly, and the first power supply unit and the second power supply unit can make the vaporization assembly have larger vaporization efficiency; and the control unit is configured to control the first power supply unit and the second power supply unit to supply power to the vaporization assembly according to a temperature of the vaporization assembly. This solution can make the vaporization assembly reach the desired vaporization temperature in a short time, so that the user has the better experience of inhaling.

In an optional implementation solution, that the control unit is configured to control the first power supply unit and the second power supply unit to supply power to the vaporization assembly according to the temperature of the vaporization assembly is specifically that the control unit controls at least one of the first power supply unit and the second power supply unit to stop supplying power to the vaporization assembly when the temperature of the vaporization assembly exceeds a preset temperature T. According to the desired vaporization temperature of the vaporization assembly, the stopping supplying power reduces energy consumption of the at least one of the first power supply unit and the second power supply unit.

In an optional implementation solution, the vaporization assembly includes at least a first vaporization unit and a second vaporization unit, where the first power supply unit supplies power to the first vaporization unit, and the second power supply unit supplies power to the second vaporization unit. At the initial stage of startup of this solution, the first power supply unit and the second power supply unit respectively supply power to the first vaporization unit and the second vaporization unit, which makes a user operation more convenient.

In an optional implementation solution, in a working state of the electronic vaporization device, vaporization efficiency of the first vaporization unit is higher than vaporization efficiency of the second vaporization unit. The higher vaporization efficiency of the first vaporization unit enables the user to use the electronic vaporization device without waiting for a long time at the initial stage of the startup.

In an optional implementation solution, the first vaporization unit has a resistance R1 less than a resistance R2 of the second vaporization unit. In this solution, the first vaporization unit has the resistance R1 less than the resistance R2 of the second vaporization unit. In this way, the vaporization efficiency of the first vaporization unit is higher than the vaporization efficiency of the second vaporization unit, thereby enabling the user to use the electronic vaporization device without waiting for a long time at the initial stage of the startup.

In an optional implementation solution, a working current I1 provided by the first power supply unit for the first vaporization unit is greater than a working current I2 provided by the second power supply unit for the second vaporization unit. In this solution, the working current I1 provided by the first power supply unit for the first vaporization unit is greater than the working current I2 provided by the second power supply unit for the second vaporization unit. In this way, the vaporization efficiency of the first vaporization unit is higher than the vaporization efficiency of the second vaporization unit, thereby enabling the user to use the electronic vaporization device without waiting for a long time at the initial stage of the startup.

In an optional implementation solution, the vaporization assembly includes a liquid guide member, configured to supply the aerosol generating substrate for the first vaporization unit and the second vaporization unit, where the first vaporization unit and the second vaporization unit are in liquid guide connection to the liquid guide member. The liquid guide member adsorbs the aerosol generating substrate for the vaporization of the vaporization assembly. The first vaporization unit and the second vaporization unit may be arranged on the same liquid guide member, which makes the vaporization assembly simpler and more convenient, and the heat of the first vaporization unit and the heat of the second vaporization unit can be transferred to each other, which is more beneficial to the utilization of the heat.

In an optional implementation solution, the vaporization assembly includes a first liquid guide member and a second liquid guide member. The first liquid guide member and the second liquid guide member respectively supply the aerosol generating substrate for the first vaporization unit and the second vaporization unit. The first vaporization unit is in liquid guide connection to the first liquid guide member, and the second vaporization unit is in liquid guide connection to the second liquid guide member. In this solution, the first liquid guide member and the second liquid guide member are respectively in liquid guide connection to the first liquid guide member and the second liquid guide member, which makes mounting more convenient.

In an optional implementation solution, the electronic vaporization device further includes a temperature detection unit, where the temperature detection unit detects the temperature according to an attribute of the vaporization assembly such as a TCR curve of the vaporization assembly. During heating, the resistance of the vaporization assembly varies as the temperature varies. The resistance of the vaporization assembly is detected, so as to detect the real-time working temperature of the vaporization assembly. This solution directly uses the attribute of the vaporization assembly to detect the temperature, which reduces components and mounting, thereby reducing costs. The temperature detection unit may alternatively be a temperature sensor, such as an NTC element or an infrared temperature detection element, configured to detect whether the working temperature exceeds a preset temperature. The control unit controls the power supply unit to work according to the detected temperature.

In an optional implementation solution, the temperature detection unit detects the temperature of the second vaporization unit. When the temperature of the second vaporization unit reaches a certain preset temperature, the control unit controls the first power supply unit to stop supplying power to the first vaporization unit. The control unit controls the second power supply unit to still supply power to the second vaporization unit. Therefore, partial energy is saved.

The electronic vaporization device provided by this application includes the vaporization assembly, the first power supply unit, the second power supply unit, and the control unit, where the vaporization assembly is configured to vaporize the aerosol generating substrate; the first power supply unit and the second power supply unit are configured to supply power to the vaporization assembly; the control unit is configured to control the first power supply unit and the second power supply unit to supply power to the vaporization assembly according to the temperature of the vaporization assembly. When the electronic vaporization device is working, the power supply units make at least one of the first vaporization unit and the second vaporization unit heat up in a short time, so that the vaporization efficiency is improved and the vaporization taste is good. In addition, when the temperature of the vaporization assembly reaches the certain preset value, at least one of the first power supply unit and the second power supply unit stops supplying power to the vaporization assembly, which saves energy and improves working efficiency of the electronic vaporization device.

In order to have a clearer understanding of the technical characteristics, purposes, and effects of the present disclosure, the specific embodiments of the present disclosure are described in detail in comparison with the accompanying drawings.

It should be understood that terms such as "up", "down", "first", and "second" are only for the convenience of describing the technical solutions of the present disclosure instead of indicating that the devices or units need to have special differences, and therefore cannot be understood as a limitation on the present disclosure. It should be noted that when a member is considered to be "connected" to another member, the member may be directly connected to the another member or there may be an intermediate member between the two members. Unless otherwise defined, meanings of all technical and scientific terms used herein are the same as meanings generally understood by a person of skill in the technological field of the present disclosure. The terms used in the specification of the present disclosure are only for the purpose of describing specific embodiments and are not intended to limit the present disclosure.

FIG. 1 shows an electronic vaporization device 10 provided by an embodiment of the present disclosure. Specifically, the electronic vaporization device 10 includes: a vaporization assembly 11, a first power supply unit 131, a second power supply unit 132, and a control unit 15, where the first power supply unit 131 and the second power supply unit 132 supply power to the vaporization assembly 11 under the control of the control unit 15.

At the initial stage at which the electronic vaporization device 10 enters a working state, the control unit 15 controls the first power supply unit 131 and the second power supply unit 132 to supply power to the vaporization assembly 11, so that the vaporization assembly 11 obtains a larger vaporization power in a short time, thereby making the vaporization assembly 11 generate a vaporized aerosol generating substrate with a good taste in a short time, and providing a better user experience.

As the electronic vaporization device 10 starts working, the temperature of the vaporization assembly 11 gradually rises. The control unit 15 controls the power supply of the first power supply unit 131 and the second power supply unit 132 to the vaporization assembly 11 according to the temperature of the vaporization assembly 11.

The aerosol generating substrate has a desired vaporization temperature T. At the desired vaporization temperature T, aerosol vaporized from the aerosol generating substrate has a larger amount and a better taste. In an implementation solution provided by the present disclosure, referring to FIG. 1, when the first power supply unit 131 and the second power supply unit 132 supply power to the vaporization assembly 11, the vaporization assembly 11 heats up in a short time. The vaporization assembly 11 reaches the desired vaporization temperature T, thereby making the aerosol have a larger amount and a better taste. In this case, if the control unit 15 continues controlling the first power supply unit 131 and the second power supply unit 132 to supply power to the vaporization assembly 11, the temperature of the vaporization assembly 11 will exceed the preset temperature T. The excessively high vaporization temperature may burn the device, or when the vaporization temperature is too high, the aerosol generating substrate vaporized by the vaporization assembly 11 has a bad taste and a poor user experience. In order to avoid the above situation, the control unit 15 controls at least one of the first power supply unit 131 and the second power supply unit 132 to stop supplying power to the vaporization assembly 11 to prevent the excessively high temperature from damaging the device, and controls the temperature to fall within a proper vaporization temperature range so as to make the vaporized aerosol generating substrate taste good.

Figure 2:
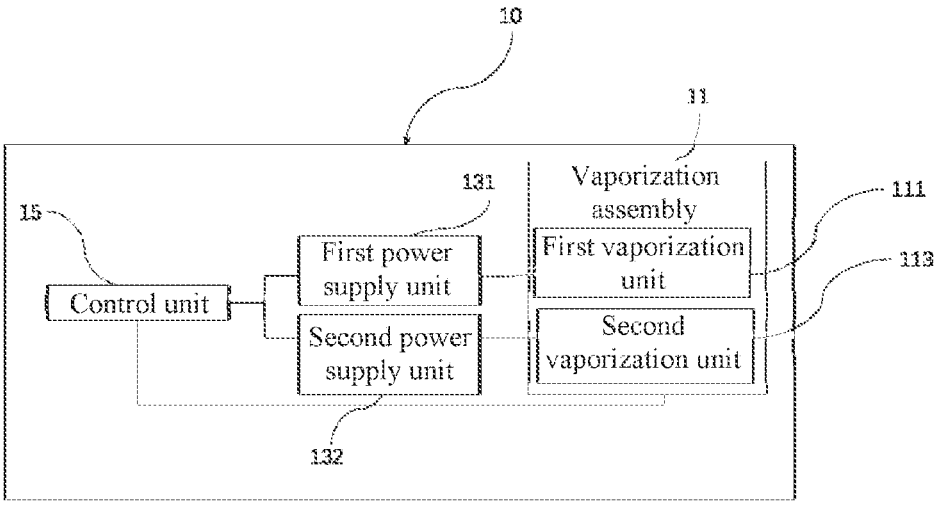
FIG. 2 is a structural block diagram of an electronic vaporization device in another embodiment of the present disclosure.

In one of the embodiments, referring to FIG. 2, the vaporization assembly 11 further includes a first vaporization unit 111 and a second vaporization unit 113. At the initial working stage of the electronic vaporization device 10, the first power supply unit 131 supplies power to the first vaporization unit 111, so that the first vaporization unit 111 heats up in a short time. The first vaporization unit 111 vaporizes the aerosol generating substrate for the user to inhale. As the electronic vaporization device 10 continues working, the vaporization assembly 11 continues heating up. When the temperature of the vaporization assembly 11 exceeds the preset temperature T, the control unit 15 controls the first power supply unit 131 to stop supplying power to the first vaporization unit 111. In this case, the first power supply unit 131 stops supplying power to the first vaporization unit 111, and the first vaporization unit 111 stops vaporizing the aerosol generating substrate. However, the second power supply unit 132 supplies power to the second vaporization unit 113, and the vaporization temperature reaches the desired temperature of vaporizing the aerosol generating substrate. The second vaporization unit 113 continuous vaporizing the aerosol generating substrate for the user to inhale. The first power supply unit 131 stops working, which can save electric energy of the first power supply unit 131.

In one of the implementations, vaporization efficiency of the first vaporization unit 111 is higher than vaporization efficiency of the second vaporization unit 113. Vaporization efficiency P is determined by a voltage and a current in a circuit, namely P=U*I, and the vaporization efficiency P is positively correlated with the voltage and the current I in the circuit. To achieve higher vaporization efficiency, optionally, the power supply voltage of the first power supply unit 131 is greater than or equal to that of the second power supply unit 132. For example, the first vaporization unit 111 and the second vaporization unit 113 may be resistance heating units, such as heating wires. It is assumed that a resistance of the first vaporization unit 111 is R1, and a resistance of the second vaporization unit 113 is R2. When the first power supply unit 131 supplies power to the resistance R1 of the first vaporization unit 111, and the second power supply unit 132 supplies power to the resistance R2 of the second vaporization unit 113, if the resistance R1 is less than the resistance R2, heating-up efficiency of the first vaporization unit 111 is higher than that of the second vaporization unit 113. The first vaporization unit 111 gives priority to vaporizing the aerosol generating substrate, which gives the user the better experience of inhaling.

Figure 3:
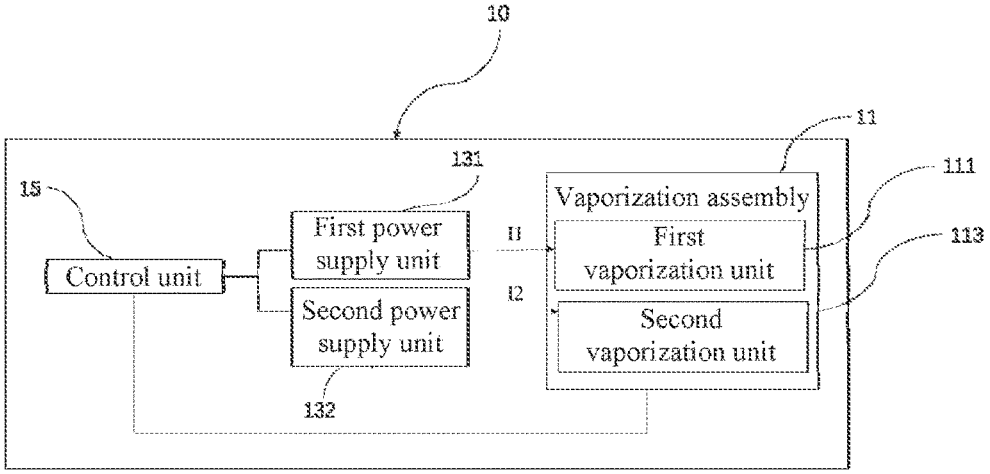
FIG. 3 is a structural block diagram of an electronic vaporization device in another embodiment of the present disclosure.

In one of the implementations, referring to FIG. 3, when a working current I1 provided by the first power supply unit 131 for the first vaporization unit 111 is greater than a working current I2 provided by the second power supply unit 132 for the second vaporization unit 113 and the resistance R1 is less than or equal to the resistance R2, the heating-up efficiency of the first vaporization unit 111 is higher than that of the second vaporization unit 113. The first vaporization unit 111 gives priority to vaporizing the aerosol generating substrate, which gives the user the better experience of inhaling.

The first power supply unit 131 may be a device that can provide larger power for the vaporization assembly 11 in a short time. Optionally, the first power supply unit 131 may be a super capacitor, and the second power supply unit 132 is a general discharging device. Optionally, the second power supply unit 132 may be a lithium battery, which can stably and continuously supply power to the vaporization assembly 11.

Figure 4:
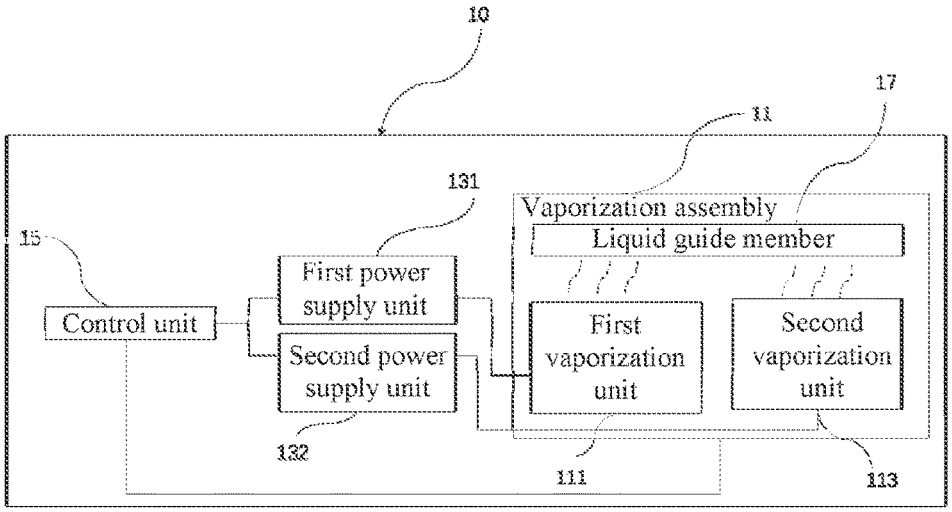
FIG. 4 is a structural block diagram of an electronic vaporization device in another embodiment of the present disclosure.

In one of the embodiments, the electronic vaporization device 10 further includes an aerosol generating substrate carrier, configured to carry the aerosol generating substrate for the vaporization of the first vaporization unit 111 and the second vaporization unit 113. The aerosol generating substrate carrier may be a liquid guide member 17. Referring to FIG. 4 for details, the liquid guide member 17 may be an adsorption member made of a material with a porous structure. For example, the liquid guide member 17 may be made of porous ceramic or absorbent cotton. The first vaporization unit 111 and the second vaporization unit 113 are in liquid guide connection to the liquid guide member 17. For example, the first vaporization unit 111 and the second vaporization unit 113 are closely attached to the liquid guide member 17, or the first vaporization unit 111 and the second vaporization unit 113 are silk-screen printed on the same liquid guide member 17. After the porous structure of the liquid guide member 17 absorbs the aerosol generating substrate, the first vaporization unit 111 and the second vaporization unit 113 generate heat to vaporize the aerosol generating substrate absorbed by the liquid guide member 17. Because a heating-up rate of the first vaporization unit 111 and a heating-up rate of the second vaporization unit 113 are different, the heat of the first vaporization unit 111 and the heat of the second vaporization unit 113 are transferred to each other, which is more beneficial to utilization of the heat.

Figure 5:
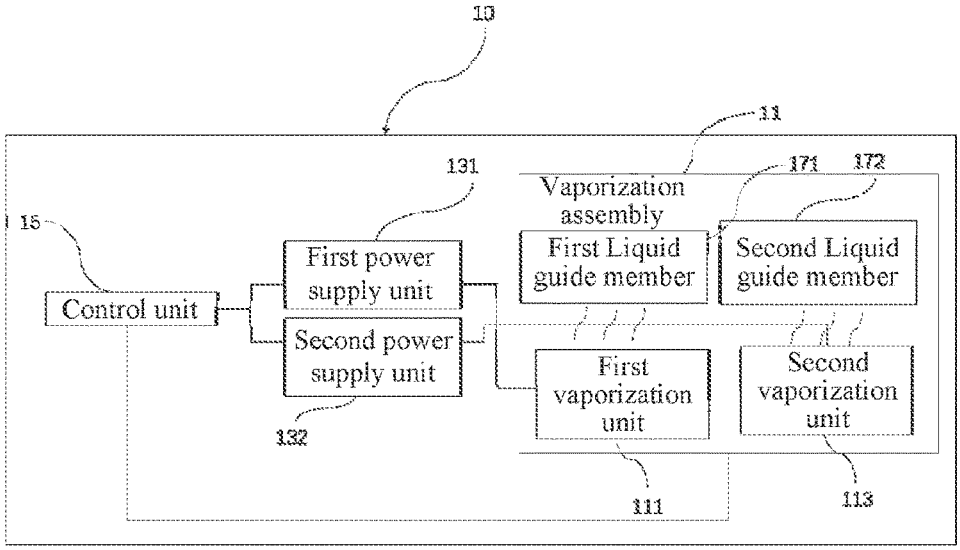
FIG. 5 is a structural block diagram of an electronic vaporization device in another embodiment of the present disclosure.

In one of the embodiments, referring to FIG. 5, the vaporization assembly 11 includes a first liquid guide member 171 and a second liquid guide member 172, where the first liquid guide member 171 and the second liquid guide member 172 respectively supply the aerosol generating substrate to the first vaporization unit 111 and the second vaporization unit 113.

Optionally, in another embodiment, the aerosol generating substrate carrier may be a container such as a pipe bowl and carries the aerosol generating substrate. In this case, the first vaporization unit 111 and the second vaporization unit 113 may be welded or silk-screen printed onto the container, namely the pipe bowl. It is understandable that the first vaporization unit 111 and the second vaporization unit 113 may be arranged in the same pipe bowl or different pipe bowls.

Figure 6A:
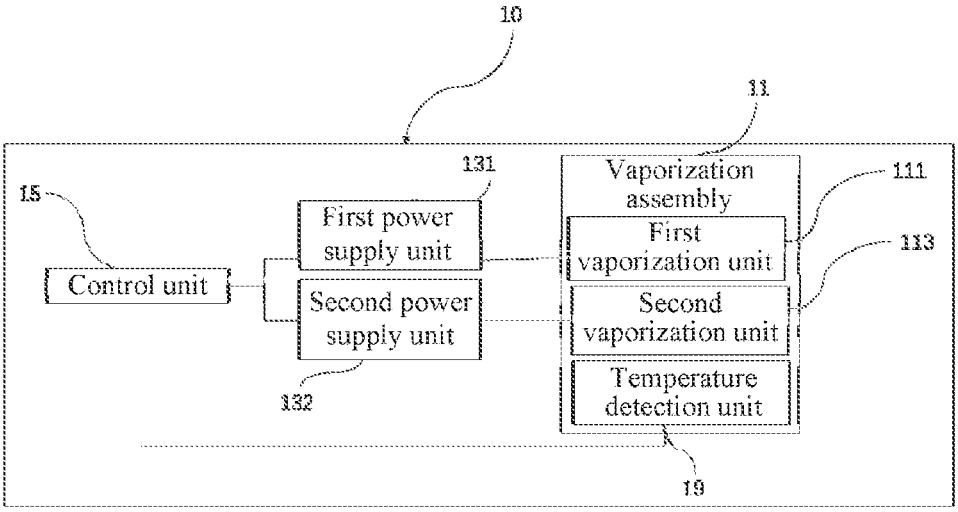
FIG. 6A to FIG. 6C are structural block diagrams of an electronic vaporization device in another embodiment of the present disclosure.

In one of the embodiments, referring to FIG. 6A, this device further includes a temperature detection unit 19, where the temperature detection unit 19 can detect the temperature according to an attribute of the vaporization assembly 11. For example, the temperature is detected according to a TCR temperature curve of the vaporization assembly 11. According to the temperature of the vaporization assembly 11 detected by the temperature detection unit 19, the control unit 15 controls the first power supply unit 131 and the second power supply unit 132 to supply power to the first vaporization unit 111 and the second vaporization unit 113. The temperature detection unit 19 of this solution detects the temperature according to the attribute of the vaporization assembly 11, which reduces components of the device, mounting steps, and production costs.

Figure 6B:
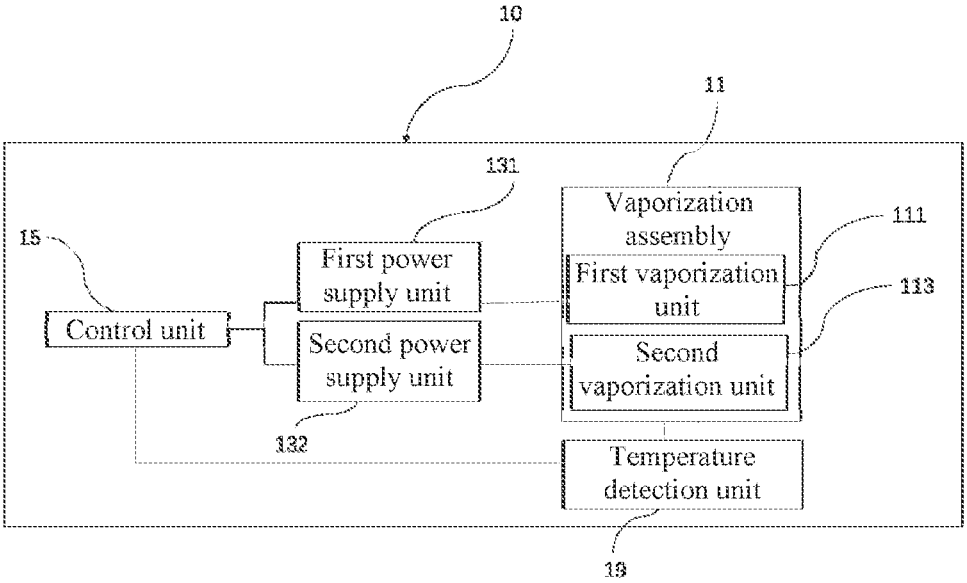

In some implementations, the temperature detection unit 19 may alternatively be a temperature sensor, such as an NTC temperature sensor, or an infrared temperature sensor, which is arranged outside the vaporization assembly 11. For details, reference may be made to FIG. 6B.

Figure 6C:
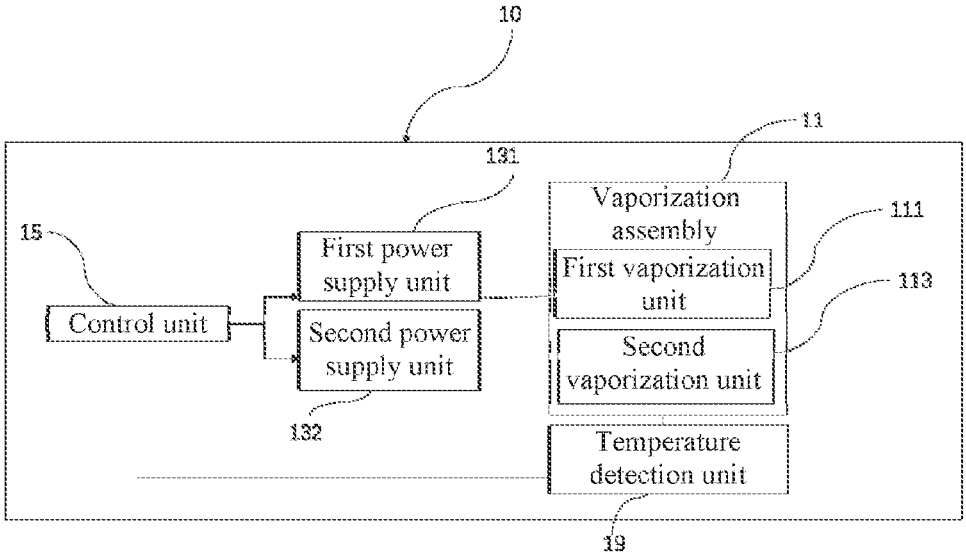

In some implementations, referring to FIG. 6C for details, the temperature detection unit 19 detects the temperature of the second vaporization unit 113. When the temperature exceeds the preset temperature T, the control unit 15 controls the first power supply unit 131 to stop supplying power to the first vaporization unit 111 so as to save energy, and the second power supply unit 132 still supplies power to the second vaporization unit 113.

The present disclosure provides an electronic vaporization device. When the electronic vaporization device 10 is working, the first power supply unit 131 supplies power to the first vaporization unit 111, which heats up rapidly to vaporize the aerosol generating substrate. The second power supply unit 132 supplies power to the second vaporization unit 113. In this process, because the heating-up efficiency of the first vaporization unit 111 is higher than that of the second vaporization unit 113, the temperature of the first vaporization unit 111 is higher than the temperature of the second vaporization unit 113. The first vaporization unit 111 can preheat the second vaporization unit 113 to save the energy. After the temperature detection unit 19 detects that the temperature of the second vaporization unit 113 exceeds the preset temperature T, the control unit 15 controls the first power supply unit 131 to stop supplying power to the first vaporization unit 111, and the second power supply unit 132 continuously supplies power to the second vaporization unit 113 so that the vaporization assembly can continuously generate the aerosol generating substrate. The first power supply unit 131 can make the first vaporization unit 111 heat up quickly, and the aerosol generating substrate is vaporized rapidly. The user can inhale quickly, which improves working efficiency of the electronic vaporization device.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. An electronic vaporization device, comprising:

a vaporization assembly;

a first power supply unit comprising a super capacitor configured to supply power to the vaporization assembly;

a second power supply unit comprising a lithium battery configured to supply power to the vaporization assembly; and a control unit, wherein the vaporization assembly is configured to vaporize an aerosol generating substrate, and wherein the control unit is configured to control the first power supply unit and the second power supply unit to supply power to the vaporization assembly according to a temperature of the vaporization assembly, wherein the vaporization assembly comprises at least a first vaporization unit and a second vaporization unit, wherein the first power supply unit is configured to supply power to the first vaporization unit, wherein the second power supply unit is configured to supply power to the second vaporization unit, wherein the vaporization assembly comprises a liquid guide member configured to supply the aerosol generating substrate for the first vaporization unit and the second vaporization unit, and wherein the first vaporization unit and the second vaporization unit are in liquid guide connection to the liquid guide member.

2. The electronic vaporization device of claim 1, wherein the control unit is configured to control at least one of the first power supply unit and the second power supply unit to stop supplying power to the vaporization assembly when the temperature of the vaporization assembly exceeds a preset temperature.

3. The electronic vaporization device of claim 1, wherein, in a working state of the electronic vaporization device, a vaporization efficiency of the first vaporization unit is higher than a vaporization efficiency of the second vaporization unit.

4. The electronic vaporization device of claim 3, wherein the first vaporization unit has a resistance less than a resistance of the second vaporization unit.

5. The electronic vaporization device of claim 3, wherein a working current provided by the first power supply unit for the first vaporization unit is greater than a working current provided by the second power supply unit for the second vaporization unit.

6. The electronic vaporization device of claim 1, further comprising:

a temperature detection unit configured to detect the temperature according to an attribute of the vaporization assembly, or wherein the temperature detection unit comprises a temperature sensor.

7. The electronic vaporization device of claim 6, wherein the temperature detection unit is configured to detect a temperature of a second vaporization unit.

8. The electronic vaporization device of claim 6, wherein the temperature detection unit is arranged within the vaporization assembly.

9. The electronic vaporization device of claim 6, wherein the temperature detection unit is arranged outside the vaporization assembly.

10. The electronic vaporization device of claim 1, wherein at least one of the first vaporization unit and the second vaporization unit comprises a heating wire.

11. The electronic vaporization device of claim 1, wherein the liquid guide member comprises a material with a porous structure.

12. The electronic vaporization device of claim 1, wherein at least one of the first vaporization unit and the second vaporization unit is attached to the liquid guide member.

13. The electronic vaporization device of claim 1, wherein at least one of the first vaporization unit and the second vaporization unit is silk-screen printed on the liquid guide member.

14. The electronic vaporization device of claim 1, wherein the vaporization assembly comprises an aerosol generating substrate carrier configured to carry the aerosol generating substrate for at least one of the first vaporization unit and the second vaporization unit.

15. The electronic vaporization device of claim 14, wherein the aerosol generating substrate carrier comprises a container configured to carry the aerosol generating substrate.

16. An electronic vaporization device, comprising:

a vaporization assembly configured to vaporize an aerosol generating substrate;

a first power supply unit; and a second power supply unit, wherein the vaporization assembly comprises a first vaporization unit and a second vaporization unit that are in liquid guide connection to a liquid guide member configured to supply the aerosol generating substrate, wherein the first power supply unit comprises a super capacitor configured to supply power to the first vaporization unit of the vaporization assembly, and wherein the second power supply unit comprises a lithium battery configured to supply power to the second vaporization unit of the vaporization assembly.

17. The electronic vaporization device of claim 16, wherein the first vaporization unit and the second vaporization unit are configured to transfer heat to one another.

* * * * *